US012781742B2

(12) United States Patent
Feng et al.

(10) Patent No.: US 12,781,742 B2
(45) Date of Patent: Nov. 3, 2026

(54) COMPRESSOR

(71) Applicant: Hitachi-Johnson Controls Air Conditioning, Inc., Tokyo (JP)

(72) Inventors: Allen Feng, Tokyo (JP); Jason Peng, Tokyo (JP); Ben Ma, Tokyo (JP); Allen Zhu, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 0 days.

(21) Appl. No.: 19/259,054

(22) Filed: Jul. 3, 2025

(65) Prior Publication Data

US 2026/0168494 A1 Jun. 18, 2026

(30) Foreign Application Priority Data

Dec. 12, 2024 (CN) ..... 202411832585.3

(51) Int. Cl.
*F04C 18/02* (2006.01)
*F04C 29/06* (2006.01)
*F04C 29/12* (2006.01)

(52) U.S. Cl.
CPC ..... *F04C 18/0261* (2013.01); *F04C 18/0215* (2013.01); *F04C 29/068* (2013.01); *F04C 29/12* (2013.01); *F04C 2240/30* (2013.01)

(58) Field of Classification Search
CPC ..... F04C 18/0261; F04C 18/0215; F04C 29/068; F04C 29/12; F04C 2240/30
See application file for complete search history.

(56) References Cited

U.S. PATENT DOCUMENTS 7,862,312 B2 * 1/2011 Gopinathan ..... F04C 23/008 418/55.1
11,549,511 B2 1/2023 Jo
2006/0222545 A1 * 10/2006 Nam ..... F04C 18/0253 418/55.1
2006/0245967 A1 * 11/2006 Gopinathan ..... F04C 29/12 418/55.4

FOREIGN PATENT DOCUMENTS

JP H1122663 A * 1/1999
JP 3227075 B2 * 11/2001

* cited by examiner

*Primary Examiner* — Jesse S Bogue
(74) *Attorney, Agent, or Firm* — MATTINGLY & MALUR, PC

(57) ABSTRACT

A compressor with a fixed scroll that includes an intake guide passage. The casing includes an intake pipe and the intake guide passage includes a main intake port, an auxiliary intake port, and an outlet port that communicate with each other. The fixed scroll includes an intake cover, and an end face of an end of the intake cover facing towards the orbiting scroll is an open end face. The main intake port is located on the open end face, and the auxiliary intake port is provided on other surfaces of the intake cover than the open end face, and the outlet port communicates with an intake port of the compression chamber, and the main and auxiliary intake ports each communicate with the intake pipe.

10 Claims, 4 Drawing Sheets

COMPRESSOR

CROSS-REFERENCE TO RELATED APPLICATION

The present application claims priority from Chinese Patent Application CN 202411832585.3, filed on Dec. 12, 2024, the content of which is hereby incorporated by reference into this application.

TECHNICAL FIELD

The present application relates to the field of gas compression devices, in particular to a compressor.

BACKGROUND

In related art, a compressor is a fluid machine that converts low-pressure gas into high-pressure gas, and is an important component of a refrigeration system. The compressor mainly sucks low-pressure gas from a low-pressure chamber into a compression chamber and discharges the compressed high-pressure gas to a high-pressure chamber, in order to achieve the conversion of the low-pressure gas into the high-pressure gas. However, when an intake speed of the compression chamber is fast, significant noise will be generated, resulting in the problem of noise pollution.

SUMMARY

Embodiments of the present application provide a compressor to solve the problem of noise pollution generated during the operation of the compressor.

In order to solve this technical problem, the present application is implemented as follows:

In a first aspect, an embodiment of the present application provides a compressor, including a casing, a fixed scroll and an orbiting scroll each disposed in the casing, wherein the fixed and orbiting scrolls is cooperatively connected to each other and encircle a compression chamber therebetween, and the fixed scroll includes an intake guide passage;

the casing includes an intake pipe, the intake guide passage includes a main intake port, an auxiliary intake port, and an outlet port that communicate with each other, and the fixed scroll includes an intake cover; an end face of an end of the intake cover facing towards the orbiting scroll is an open end face, the main intake port is located on the open end face, and the auxiliary intake port is provided on other surfaces of the intake cover than the open end face; and the outlet port communicates with an intake port of the compression chamber, and each of the main and auxiliary intake ports communicates with the intake pipe.

In the embodiment of the present application, the intake guide passage includes main and auxiliary intake ports each communicating with the intake pipe, and has an outlet port communicating with an intake port of the compression chamber. In this way, the compression chamber can suck gas from the intake pipe through the main and auxiliary intake ports. Since the auxiliary intake port can provide the auxiliary intake, and the intake volume of the compression chamber is relatively fixed, adding the auxiliary intake port can reduce the intake speed of the main intake port, thereby reducing the noise during the operation of the compressor.

BRIEF DESCRIPTION OF THE DRAWINGS

In order to more clearly illustrate the technical solutions of the embodiments of the present application, the accompanying drawings required to use in the description of the embodiments of the present application are briefly introduced below, and it is obvious that the drawings in the following description are merely some of the embodiments of the present application, and for those having ordinary skills in the art, other drawings can be obtained based on the drawings in the following description without requiring any inventive skills.

DETAILED DESCRIPTION

Figure 1:
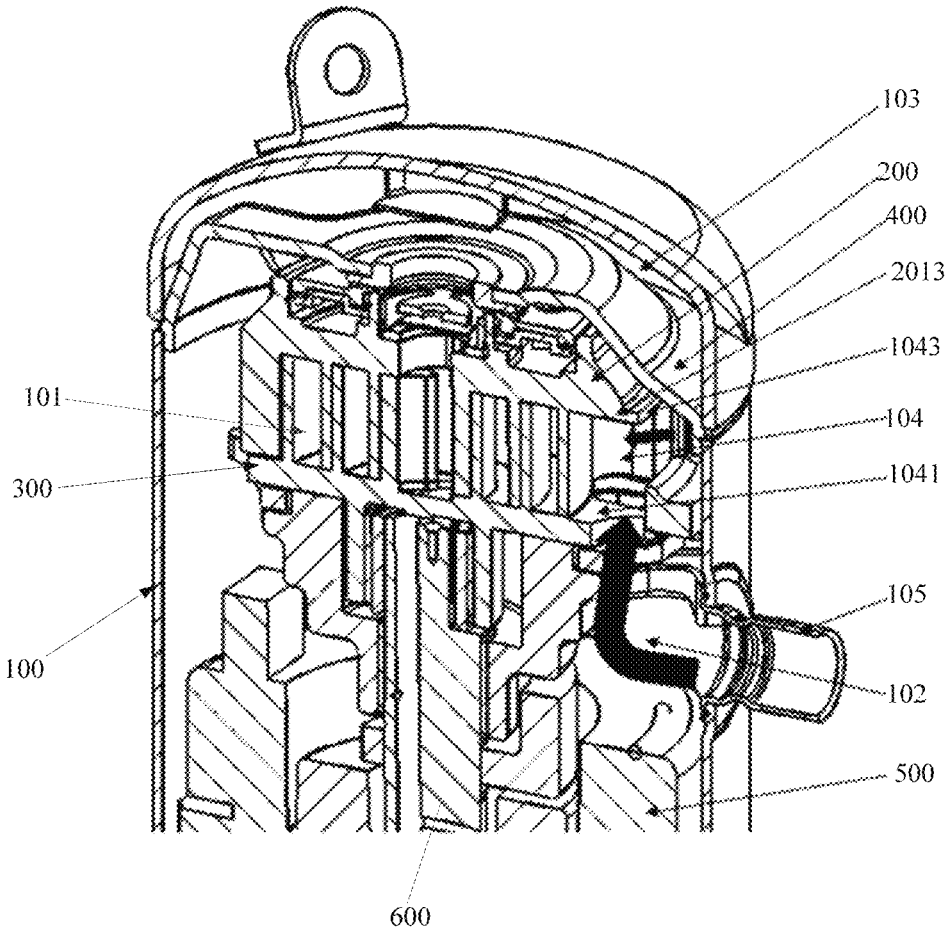
FIG. 1 is a schematic diagram of an internal structure of a compressor in an embodiment of the present application.
Figure 2:
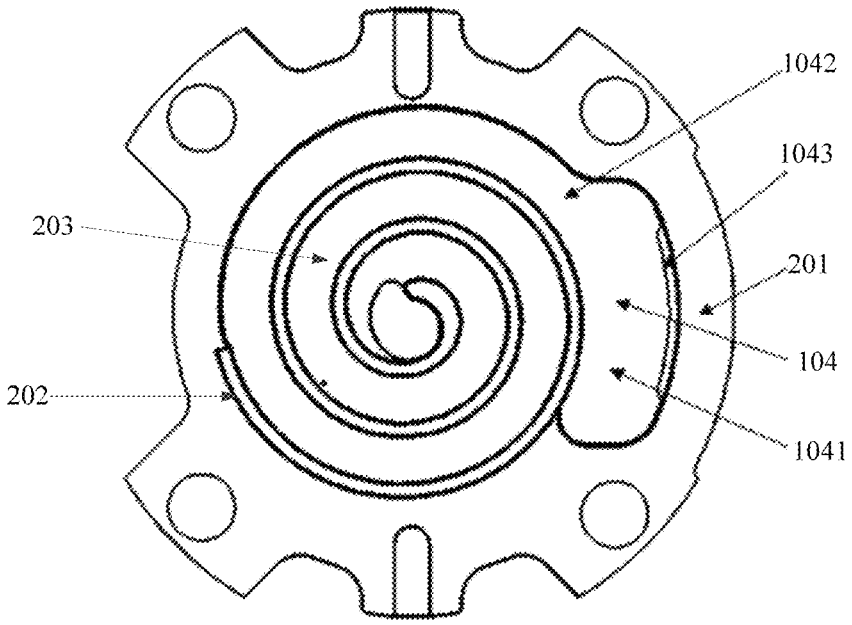
FIG. 2 is a first structural schematic diagram of a fixed scroll in the embodiment of the present application.

Hereinafter, technical solutions in the embodiments of the present application will be described clearly and completely in conjunction with the drawings in the embodiments of the present application. Apparently, the described embodiments are a part, but not all, of the embodiments of the present application. All other embodiments, which are obtained by those having ordinary skills in the art based on the embodiments in the present application without exercising inventive skills, fall within the scope of protection of the present application.

Referring to FIGS. 1 to 7, they show a compressor provided in an embodiment of the present application. The compressor includes a casing 100, a fixed scroll 200 and an orbiting scroll 300 each disposed in the casing 100. The fixed and orbiting scrolls 200, 300 are cooperatively connected to each other and encircle a compression chamber 101 therebetween, and the fixed scroll 200 includes an intake guide passage 104.

The casing 100 includes an intake pipe 105. The intake guide passage 104 includes a main intake port 1041, an auxiliary intake port 1043, and an outlet port 1042 that communicate with each other. The fixed scroll 200 includes an intake cover 201, and an end face of an end of the intake cover 201 facing towards the orbiting scroll 300 is an open end face. The main intake port 1041 is located on the open end face, and the auxiliary intake port 1043 is provided on other surfaces of the intake cover 201 than the open end face. The outlet port 1042 communicates with an intake port of the compression chamber 101, and each of the main and auxiliary intake ports 1041, 1043 communicates with the intake pipe 105.

The intake cover 201 may serve as an outer wall of the fixed scroll 200, and the fixed scroll 200 may further include a fixed scroll wrap 202. The fixed scroll wrap 202 may be accommodated inside the intake cover 201, and the intake cover 201 may be fixedly connected to the fixed scroll wrap 202.

The orbiting scroll 300 may rotate relative to the fixed scroll 200. Specifically, the orbiting scroll 300 may reciprocally rotate within a certain angle range relative to the fixed scroll 200 to achieve gas compression.

The compressor described above may be a scroll compressor, and may be specifically used as a compressor in a heat pump system of an air conditioner. The principle of gas compression by the compressor may be the same as that of various compressors in the heat pump systems of the air conditioners in related art. Accordingly, in the embodiment of the present application, relative structures for gas compression in the compressor may be the same as those inside the various compressors in the heat pump systems of the air conditioners in related art. For example, in some embodiments of the present application, the compressor may include a crankshaft 600 and a rotary drive assembly 500, and the bottom of the casing 100 may be provided with an oil tank for storing lubricating oil. The casing 100 may further includes a first cavity 102, which may serve as a low-pressure chamber, a second cavity 103, which may serve as a high-pressure chamber, and a discharge pipe. The intake pipe 105 may communicate with the first cavity 102 to supply a low-pressure medium to the compression chamber 101, and the discharge pipe may communicate with the second cavity 103 to discharge a high-pressure medium. A first end of the crankshaft 600 may extend into the oil tank, an end of the orbiting scroll 30 facing away from the fixed scroll 200 may be provided with a bearing seat, inside which a journal bearing may be provided, and a second end of the crankshaft 600 may be connected to the journal bearing. The rotary drive assembly 500 may be installed inside the casing 100, and has a power output end which may be connected to the crankshaft 600 to drive it in rotation. At the same time as the crankshaft 600 rotates, the crankshaft 600 can drive the orbiting scroll 300 to rotate synchronously to achieve relative rotation between the orbiting and fixed scrolls 300, 200, thereby realizing the gas compression function of the compressor. Various drive assemblies, which are capable of outputting the rotation movement, are possible for the rotary drive assembly 500. For example, it may be a conventional motor or an electromagnetic rotary motor, etc.

It will be appreciated that each of the main intake port 1041, the auxiliary intake port 1043 and the intake pipe 105 described above may communicate with the first cavity 102 described above, and each of the main and auxiliary intake ports 1041, 1043 may communicate with the intake pipe 105 through the first cavity 102. In this way, during the operation of the compressor, the low-pressure gas entering the compressor from the intake pipe 105 may enter the intake guide passage 104 along directions as indicated by two arrows in FIG. 1, and then enter the compression chamber 101 from the outlet port 1042 of the intake guide passage 104, to achieve the intake process of the compression chamber 101.

The main intake port 1041 may be an intake port formed by a partial opening area in the open end face. The auxiliary intake port 1043 may be an intake port formed by a through hole provided on a surface of the intake cover 201.

In this embodiment, the intake guide passage 104 includes the main and auxiliary intake ports 1041, 1043 each communicating with the intake pipe 105, and has the outlet port 1042 communicating with the intake port of the compression chamber 101. In this way, the compression chamber 101 may suck gas from the intake pipe 105 through the main and auxiliary intake ports 1041, 1043. Since the auxiliary intake port 1043 can provide the auxiliary intake and the intake volume of the compression chamber 101 is relatively fixed, adding the auxiliary intake port 1043 can reduce the intake speed of the main intake port 1041, thereby reducing the noise during the operation of the compressor.

Figure 3:
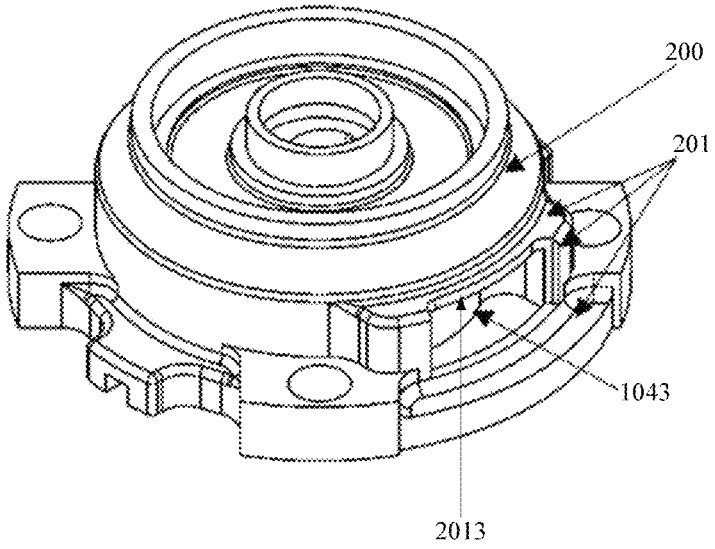
FIG. 3 is a second structural schematic diagram of the fixed scroll in the embodiment of the present application.

Optionally, referring to FIG. 3, in some embodiments of the present application, the auxiliary intake port 1043 may be provided on a side wall of the intake cover 201.

In this embodiment, the auxiliary intake port 1043 is provided on the side wall of the intake cover 201. In this way, it is possible to achieve simultaneous intake at the bottom and side faces of the fixed scroll 200.

Optionally, the main intake port 1041 has an axis which intersects with that of the auxiliary intake port 1043.

In this embodiment, the axis of the main intake port 1041 intersects with that of the auxiliary intake port 1043. Therefore, gas entering from the main intake port 1041 and that from the auxiliary intake port 1043 can converge at the intersection of their axes, and the converged gas can flow into the compression chamber 101 through the outlet port 1042.

Optionally, the side wall of the intake cover 201 is provided with a heat insulation plate 2013 protruding towards the side of an inner side wall of the casing 100 and located on a side of the auxiliary intake port 1043 away from the open end face.

The heat insulation plate 2013 as described above may be a separate component, which is connected to the intake cover 201. For example, the connection between the heat insulation plate 2013 and the intake cover 201 may be implemented by welding or a fastener, wherein the heat insulation plate 2013 may be made of cast material. In addition, the heat insulation plate 2013 may be integrally formed with the intake cover 201.

Referring to FIGS. 1 and 3, the heat insulation plate 2013 may be positioned between the auxiliary intake port 1043 and a muffling cover 400 of the compressor, wherein the muffling cover 400 may divide an internal space of the casing 100 into the first cavity 102 and the second cavity 103 as described above. Since the second cavity 103 is the high-pressure chamber, the muffling cover 400 serves as a chamber wall of the high-pressure chamber. During the operation of the compressor, the muffling cover 400 therefore has a higher temperature, and the heat insulation plate 2013 can separate the low-pressure gas entering the auxiliary intake port 1043 from the muffling cover 400 to some extent, so as to reduce the possibility of the low-pressure gas entering the casing 100 from the auxiliary intake port 1043 coming into contact with the muffling cover 400 before entering the auxiliary intake port 1043, which can further reduce the risk of the low-pressure gas entering the casing 100 from the auxiliary intake port 1043 being heated by contact with the muffling cover 400 before entering the auxiliary intake port 1043.

In this embodiment, the heat insulation plate 2013 is provided on the side of the auxiliary intake port 1043 away from the open end face. In this way, it is possible to reduce the risk of the low-pressure gas entering the casing 100 from the auxiliary intake port 1043 being heated by contact with the muffling cover 400 before entering the auxiliary intake port 1043, and thus to reduce the problem of the overheat phenomenon of the low-pressure gas entering the casing 100 from the auxiliary intake port 1043, so as to achieve a higher coefficient of performance (COP).

Optionally, the intake cover 201 includes an intake cover body 2011, and a flange plate 2012 that is located on the open end face, and the auxiliary intake port 1043 is provided in the intake cover body 2011 or in the flange plate 2012.

Figure 4:
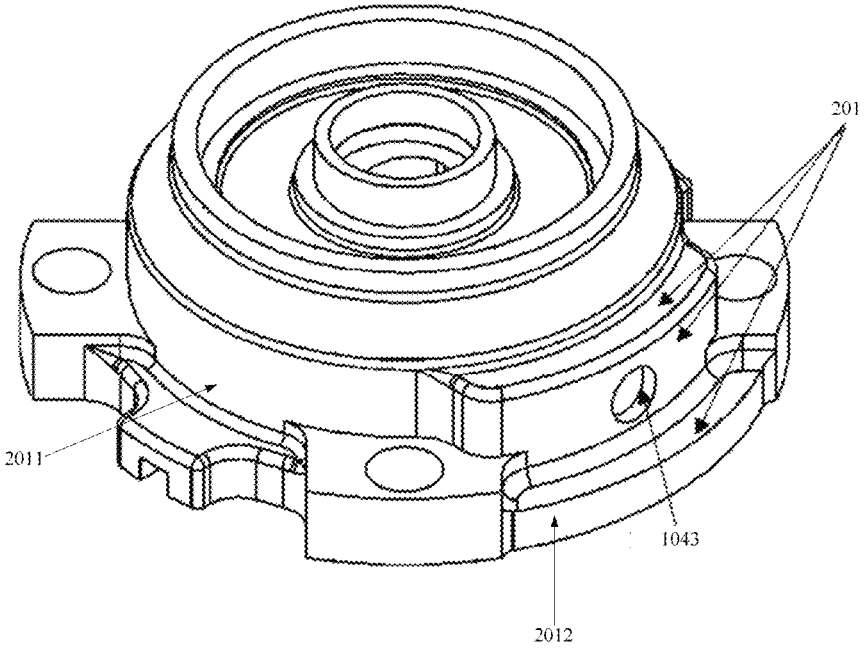
FIG. 4 is a third structural schematic diagram of the fixed scroll in the embodiment of the present application.
Figure 5:
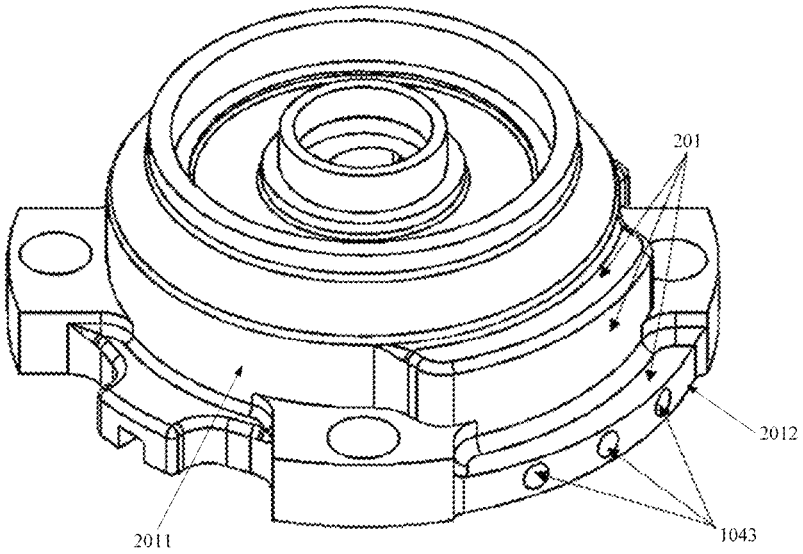
FIG. 5 is a fourth structural schematic diagram of the fixed scroll in the embodiment of the present application.

Referring to FIG. 4, in some embodiments of the present application, the auxiliary intake port 1043 is provided in the intake cover body 2011. Referring to FIG. 5, in some other embodiments of the present application, the auxiliary intake port 103 is provided in a side wall of the flange plate 2012.

In this embodiment, the auxiliary intake port 1043 is provided in the intake cover body 2011 or in the flange plate 2012. In this way, it is possible to achieve the intake from the side wall of the casing 100.

Optionally, the intake cover 201 includes a closed end face opposite to the open end face, and the auxiliary intake port 1043 is provided on the closed end face and is opposite to the main intake port 1041.

Figure 6:
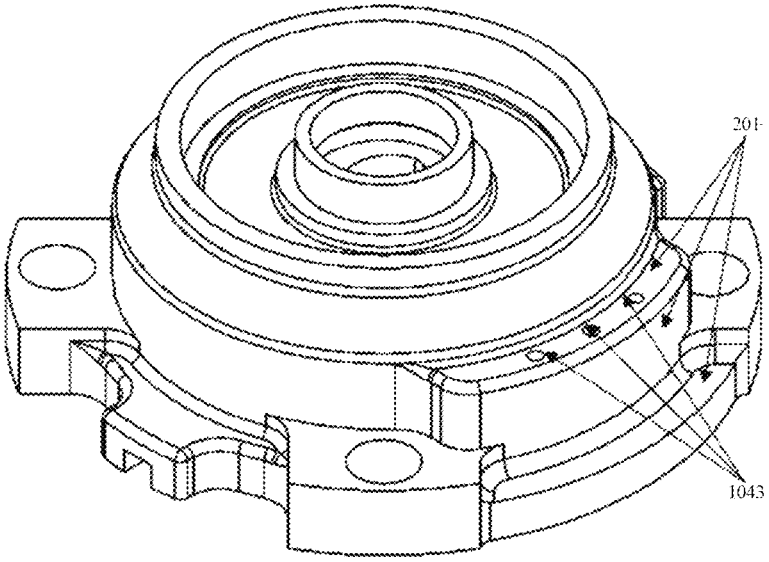
FIG. 6 is a fifth structural schematic diagram of the fixed scroll in the embodiment of the present application.

Referring to FIG. 6, in some embodiments of the present application, the auxiliary intake port 1043 is provided on the closed end face of the casing 100.

In this embodiment, the auxiliary intake port 1043 is opposite to the main intake port 1041. In this way, gas can enter from the bottom and top of the casing 100 simultaneously. At the same time, the low-pressure gas entering from the auxiliary intake port 1043 can slow down the intake speed of the main intake port 1041 to some extent, which is beneficial for further reducing the noise during the operation of the compressor.

Optionally, the intake guide passage 104 includes at least two auxiliary intake ports 1043 which are arranged at intervals around the axis of the fixed scroll 200.

Referring to FIG. 6, due to the reduced space on the closed end face of the casing 100 available for providing the auxiliary intake port 1043, two or more small auxiliary intake ports 1043 can be provided on the closed end face to increase the total intake area of the auxiliary intake ports 1043.

Accordingly, referring to FIG. 5, since the side wall of the flange plate 2012 has a relatively small thickness and is not suitable for providing a large auxiliary intake port 1043, two or more small auxiliary intake ports 1043 can be provided on the side wall of the flange plate 2012 to increase the total intake area of the auxiliary intake ports 1043.

In this embodiment, the intake guide passage 104 includes at least two auxiliary intake ports 1043, which are arranged at intervals around the axis of the fixed scroll 200, and this is beneficial for increasing the total intake area of the auxiliary intake ports 1043.

Optionally, the fixed scroll 200 includes a fixed scroll wrap 202 located inside the intake cover 201 and encircling a scroll groove 203 with the intake cover 201, and the intake guide passage 104 includes an arc-shaped groove 1044 extending outward from an outermost end of the scroll groove 203. The outlet port 1042 communicates with the main intake port 1041 through the arc-shaped groove 1044, and the arc-shaped groove 1044 has a depth which gradually increases in a direction from the main intake port 1041 to the outlet port 1042.

Figure 7:
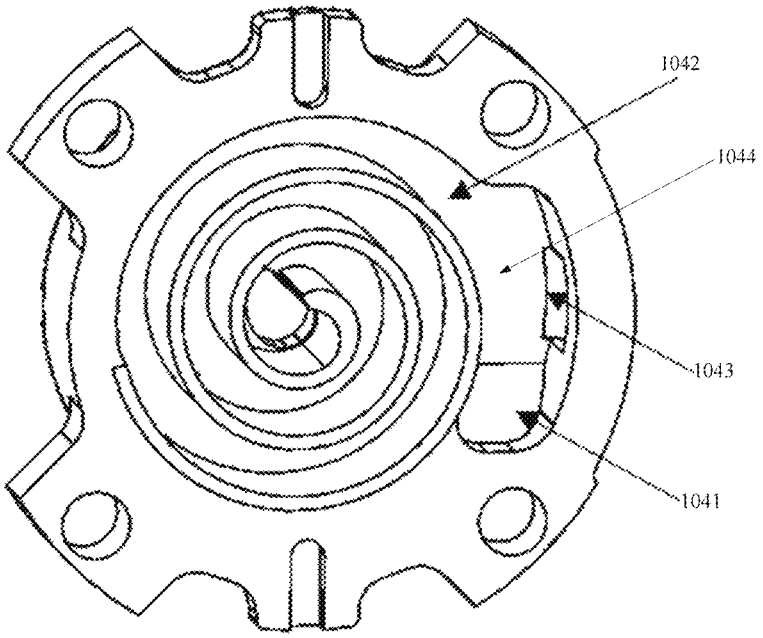
FIG. 7 is a sixth structural schematic diagram of the fixed scroll in the embodiment of the present application.

Referring to FIG. 7, since the depth at the main intake port 1041 is smaller than that at the arc-shaped groove 1044, a right angle step is usually required at the connection between the main intake port 1041 and the arc-shaped groove 1044 in FIG. 7 for transition in related art. However, the use of the right angle step for transition can easily cause the generation of vortex at the transition position.

In view of this, in the embodiments of the present application, the depth of the arc-shaped groove 1044 gradually increases in the direction from the main intake port 1041 to the outlet port 1042. That is, the arc-shaped groove 1044 has a slope, that is, the main intake port 1041 and the arc-shaped groove 1044 transition through the slope to eliminate the right angle step at the connection between the main intake port 1041 and the arc-shaped groove 1044 in related art. In this way, it is possible to reduce the vortex in the arc-shaped groove 1044.

It will be appreciated that the orbiting scroll 300 may include an orbiting scroll wrap corresponding to the fixed scroll wrap 202, and the cooperative connection between the fixed and orbiting scrolls 200, 300 may refer to the fixed scroll wrap 202 of the fixed scroll 20 intermeshing with the orbiting scroll wrap of the orbiting scroll 300 to encircle and form the compression chamber 101. A projection of the fixed scroll wrap 202 on the closed end face of the fixed scroll 200 may be an involute of a circle. Accordingly, the projection of the orbiting scroll wrap on the closed end face of the fixed scroll 200 may be also an involute of a circle.

Optionally, an open end face of the main intake port 1041 is larger than an open end face of the auxiliary intake port 1043.

In this embodiment, the open end face of the main intake port 1041 is larger than that of the auxiliary intake port 1043. In this way, it can be ensured that the low-pressure gas in the first cavity 102 is mainly introduced through the main intake port 1041 and only a small amount of gas is introduced through the auxiliary intake port 1043, thereby ensuring that the gas intake of the compression chamber 101 can be carried out normally. Moreover, since the auxiliary intake port 1043 is closer to the muffling cover 400, the gas entering from the auxiliary intake port 1043 has a higher temperature than the gas entering from the main intake port 1041. In this way, it is also possible to avoid the problem of the intake temperature of the compression chamber 101 being too high due to the high proportion of the gas entering from the auxiliary intake port 1043.

Optionally, the compressor further includes a muffling cover 400 and a discharge pipe. The muffling cover 400 is located on a side of the fixed scroll 200 facing away from the orbiting scroll 300, is hermetically connected to the inner wall of the casing 100 to divide an internal space of the casing 100 into a first cavity 102 and a second cavity 103, and is provided with an opening for communicating with the compression chamber 101.

Each of the fixed and orbiting scrolls 200, 300 is located inside the first cavity 102, and the intake pipe 105 communicates with the first cavity 102, and the discharge pipe communicates with the second cavity 103.

The muffling cover 400 may be a muffling cover 400 that is commonly used in the compressor in related art.

In this embodiment, the muffling cover 400 is provided on the side of the fixed scroll 200 facing away from the orbiting scroll 300. In this way, the muffling cover 400 can further reduce the noise generated during the operation of the compressor, which is beneficial for further reducing the noise during the operation of the compressor.

The embodiments of the present application have been described above in conjunction with the drawings, but the present application is not limited thereto, and the embodiments described above are merely illustrative rather than limiting. Under the teaching of the present application, those having ordinary skills in the art can make many forms without departing from the purpose and scope of protection of the present application, all of which fall within the protection of the present application.

What is claimed is:

1. A compressor, characterized by comprising a casing (100), a fixed scroll (200) and an orbiting scroll (300) each disposed in the casing (100), wherein the fixed and orbiting scrolls (200, 300) are cooperatively connected to each other and encircle a compression chamber (101) therebetween, and the fixed scroll (200) comprises an intake guide passage (104);

the casing (100) comprises an intake pipe (105), the intake guide passage (104) comprises a main intake port (1041), an auxiliary intake port (1043), and an outlet port (1042) that communicate with each other, and the fixed scroll (200) comprises an intake cover (201), and an end face of an end of the intake cover (201) facing towards the orbiting scroll (300) is an open end face, wherein the main intake port (1041) is located on the open end face, and the auxiliary intake port (1043) is provided on other surfaces of the intake cover (201) than the open end face, and the outlet port (1042) communicates with an intake port of the compression chamber (101), and each of the main and auxiliary intake ports (1041, 1043) communicates with the intake pipe (105).

2. The compressor according to claim 1, characterized in that the auxiliary intake port (1043) is provided on a side wall of the intake cover (201).

3. The compressor according to claim 2, characterized in that the main intake port (1041) has an axis intersecting with that of the auxiliary intake port (1043).

4. The compressor according to claim 2, characterized in that the side wall of the intake cover (201) is provided with a heat insulation plate (2013), which protrudes towards the side of an inner side wall of the casing (100) and which is located on a side of the auxiliary intake port (1043) away from the open end face.

5. The compressor according to claim 2, characterized in that the intake cover (201) comprises an intake cover body (2011), and a flange plate (2012) that is located on the open end face, and the auxiliary intake port (1043) is provided in the intake cover body (2011) or in the flange plate (2012).

6. The compressor according to claim 1, characterized in that the intake cover (201) comprises a closed end face opposite to the open end face, and the auxiliary intake port (1043) is provided on the closed end face and is opposite to the main intake port (1041).

7. The compressor according to claim 5, characterized in that the intake guide passage (104) comprises at least two auxiliary intake ports (1043), which are arranged at intervals around an axis of the fixed scroll (200).

8. The compressor according to claim 1, characterized in that the fixed scroll (200) comprises a fixed scroll wrap (202) located inside the intake cover (201) and encircling a scroll groove (203) with the intake cover (201), and the intake guide passage (104) comprises an arc-shaped groove (1044) extending outward from an outermost end of the scroll groove (203), wherein the outlet port (1042) communicates with the main intake port (1041) through the arc-shaped groove (1044), and the arc-shaped groove (1044) has a depth which gradually increases in a direction from the main intake port (1041) to the outlet port (1042).

9. The compressor according to claim 1, characterized in that an open end face of the main intake port (1041) is larger than an open end face of the auxiliary intake port (1043).

10. The compressor according to claim 1, characterized by further comprising a discharge pipe, and a muffling cover (400), which is located on a side of the fixed scroll (200) facing away from the orbiting scroll (300), which is hermetically connected to an inner wall of the casing (100) to divide an internal space of the casing (100) into a first cavity (102) and a second cavity (103), and which is provided with an opening for communicating with the compression chamber (101);

each of the fixed and orbiting scrolls (200, 300) is located inside the first cavity (102), and the intake pipe (105) communicates with the first cavity (102), and the discharge pipe communicates with the second cavity (103).

* * * * *